United States Patent [19]

Yonkers

[11] 4,383,774

[45] May 17, 1983

[54] CARTRIDGE HAVING RIBBON INVERTING MEANS

[75] Inventor: Edward H. Yonkers, Newton, Mass.

[73] Assignee: Data Packaging Corporation, Cambridge, Mass.

[21] Appl. No.: 144,349

[22] Filed: Apr. 28, 1980

[51] Int. Cl.[3] ..... B41J 33/10

[52] U.S. Cl. ..... 400/195; 400/196.1; 400/234

[58] Field of Search ..... 400/194, 195, 196, 196.1, 400/234

[56] References Cited

U.S. PATENT DOCUMENTS

| | | | |
|---|---|---|---|
| 3,432,020 | 3/1969 | Caudill et al. | 400/234 |
| 3,941,231 | 3/1976 | Matuck et al. | 400/196.1 |
| 3,989,132 | 11/1976 | Carson, Jr. | 400/196.1 X |
| 4,130,367 | 12/1978 | Guerrini et al. | 400/195 |
| 4,161,270 | 7/1979 | Casey | 400/195 X |
| 4,227,820 | 10/1980 | Falcetti | 400/195 |
| 4,232,976 | 11/1980 | Bernardis et al. | 400/195 X |
| 4,247,209 | 1/1981 | Carlson et al. | 400/195 |

*Primary Examiner*—Ernest T. Wright, Jr.
*Attorney, Agent, or Firm*—Wolf, Greenfield & Sacks

[57] ABSTRACT

A ribbon cartridge for use in a high speed band printer includes a body having a ribbon storage compartment where the ribbon is contained in a multiplicity of serpentine folds. The body has a ribbon inlet and an outlet end and guide arms extend from the inlet and outlet ends to guide the endless ribbon into and out of the cartridge and to define an exposed loop of the ribbon between the outermost end of the guide arms. The outlet end and outlet arm of the cartridge is formed to define a ribbon inverting device which serves to invert the ribbon 180° each time the ribbon passes through the device.

25 Claims, 14 Drawing Figures

R
16
32
25
36
34
25
23a
23b
40
40
38
38
R
9
22
20
10
12
14
R
8
R
18
53
42
42
44
66
62
64
60
54
52
46
3
3

30
44
26
24
46
7
7
52
50
6
6
5
5
54
56
28
58
R
4
4
64
62
66

47
46
28
48
R
42
44
26
24

47
26
52
R
53
50
24

26
R
56
54
24

18
30
61
26
58
R
60
24

CARTRIDGE HAVING RIBBON INVERTING MEANS

BACKGROUND AND SUMMARY OF THE INVENTION

This invention relates to improvements in endless printing ribbon cartridges for use in high speed band printers. Recent years have seen the development of such high speed printers, for example, of the type used in connection with computer systems or the like. It is among the desirable characteristics of such printers that there be a simple, trouble-free ribbon cartridge by which a substantially continuous supply of printing ribbon can be loaded in and fed through the printer.

It often is desirable to include a device for inverting the ribbon each time it passes through the cartridge so as to present the opposite face of the ribbon to the paper with each pass of the ribbon. For example, in my prior joint application Ser. No. 897,861 filed Apr. 19, 1978, now abandoned in favor of continuing application Ser. No. 67,770 filed Aug. 20, 1979, now U.S. Pat. No. 4,293,234 issued Oct. 6, 1981 to Edward H. Yonkers and Gilbert A. LeDonx, a mobius loop structure is incorporated in the cartridge adjacent the outlet end of the cartridge to reverse the surfaces of the ribbon. The present invention relates to further improvements in the ribbon inverting means as well as further improvements in the general construction of the cartridge by which it may be fabricated at less expense without sacrificing reliability of operation.

In brief, the cartridge includes an elongate housing which may be formed from a pair of mateable top and bottom sections which may be molded from plastic. The cartridge has an inlet and outlet end through which the printing ribbon enters and exits. A pair of arms extend from the inlet and outlet ends of the housing to define a generally U-shaped configuration, and serve to guide the ribbon into and then out of the housing. The main body of the cartridge, in-between the arms, defines a ribbon storage compartment where the ribbon is contained in a multiplicity of serpentine folds. Openings are provided in the bottom wall of the cartridge, between the inlet arm and storage chamber, to receive the drive rolls of the printer. They grip a portion of the ribbon and advance the ribbon continuously through the device.

The top and bottom members of the cartridge are formed, near the outlet end of the cartridge, to define a plurality of projections which extend internally into the cartridge and which define a plurality of ridge surfaces spaced along the path of ribbon travel which engage the ribbon and reverse it as the ribbon progresses sequentially through the series of ridges. The projections and ribbon-engaging ridges are molded directly from and are integral with the top and bottom members of the cartridge thus avoiding the necessity of fabricating and assembling more complicated types of ribbon-inverting devices. In addition, the construction of the cartridge and the manner in which the ribbon inverting ridges are formed facilitates assembly of the device as well as providing other advantages described herein.

It is among the general object of the invention to provide a ribbon cartridge for a high speed band printer having an improved, simplified and inexpensive construction.

Another object of the invention is to provide a ribbon cartridge of the type described having a ribbon-inverting means adjacent its outlet end which is formed integrally with the cartridge body.

A further object of the invention is to provide a ribbon cartridge of the type described in which the ribbon-inverting means is in the form of a series of ribbon-engaging ridges formed integrally with the cartridge and which project internally of the cartridge to engage the ribbon and guide it into an inverted configuration.

Another object of the invention is to provide a ribbon cartridge of the type described in which the ribbon-inverting means imposes minimal wear on the ribbon.

A further object of the invention is to provide a ribbon cartridge of the type described having a ribbon-inverting means which reduces assembly procedures and which results in a low cost device without sacrificing reliability of operation.

Still another object of the invention is to provide a ribbon cartridge which is low cost and of inexpensive construction and which embodies simple mechanisms whereby the device lends itself to disposable use.

DESCRIPTION OF THE DRAWING

The foregoing and other objects and advantages of the invention will be appreciated more fully from the following further description thereof, with reference to the accompanying drawing wherein.

DESCRIPTION OF THE PREFERRED EMBODIMENTS

Figure 1:
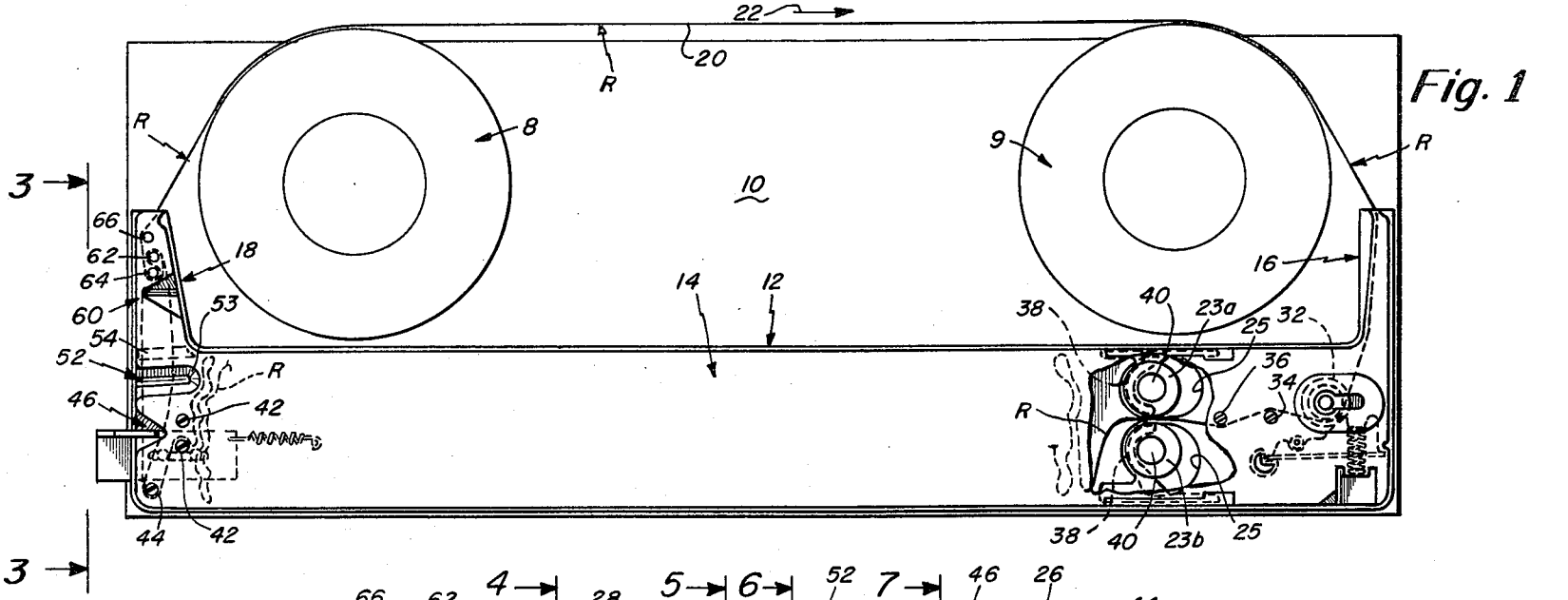
FIG. 1 is a plan view of the cartridge mounted on a portion of a high speed printer.
Figure 3:
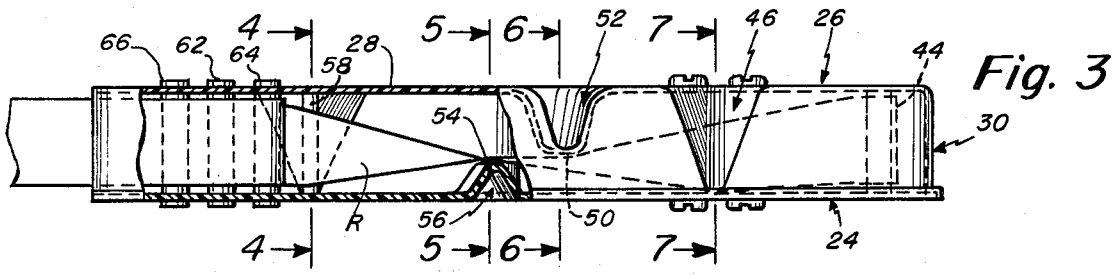
FIG. 3 is a partly broken away and partly sectioned side elevation of the outlet end of the cartridge as seen along the line 3—3 of FIG. 1.

FIG. 1 illustrates, somewhat diagrammatically, a portion of the printer 10 which receives and retains the ribbon cartridge, indicated generally at 12. The cartridge 12 includes a main body 14 and a pair of arms 16, 18 which, as shown in FIG. 1, define a generally U-shaped configuration. The cartridge 12 is formed from plastic, molded to shape, as will be described. The body 14 is constructed to contain approximately one hundred yards of printing ribbon (indicated in FIG. 1 as "R") which is folded upon itself in closely packed folds and in serpentine fashion. The stored portion of the ribbon R in the body 14 forms part of an endless ribbon with an exposed loop 20 that extends between the ends of the arms 16, 18. The ribbon R moves through the cartridge 12 and across the ends of the arms 16, 18 in the direction suggested by the arrow 22. The ribbon R is driven and transported by a pair of drive rollers 23*a*, 23*b* which are part of the printer mechanism and which extend into the body 14, through openings 25 in the bottom of the body 14, when the cartridge 12 is placed on the printer 10. The loop 20 is supported by the pair of support members 8 and 9.

The body 14 is formed in a pair of sections, including base 24 and a cover 26 which are separately molded and welded or otherwise secured together after the cartridge is loaded with the ribbon R. The various internal parts of the cartridge 12, including the ribbon R, are assembled in the cover 26 and thereafter the cover 26 and base 24 are secured together. It may be noted that the cover 26 is formed to include a top wall 28 and a skirt 30 which defines a peripheral sidewall which extends downwardly from the top wall 28. During loading of the device with its various elements, the cover 26 is inverted so that the sidewall 30 extends upwardly to provide access to the interior of the cover 26.

The ribbon R enters the inlet arm 16, and then is guided about an idler roller 32 which is rotatably supported in the body 14. The ribbon R then passes between a pair of spaced guide pins 34, 36, mounted in the cartridge 12, which preferably are provided with polished sufaces. The ribbon R then passes between the drive rollers 23*a*, 23*b* of the printer 10 which continually draw and advance the ribbon R in the direction indicated by arrow 22.

In order to prevent the closely packed serpentine ribbon R from falling out through the body openings 25 which receive the drive rollers 23*a*, 23*b* as well as to assure that the ribbon R peels smoothly from the drive rollers 23*a*, 23*b*, a ribbon control assembly is provided on the outlet side of the rollers 23*a*, 23*b*. The ribbon control assembly includes a number of vertically spaced fingers 38 associated with each roller 23*a*, 23*b* and which are disposed in horizontal planes. The fingers 38 are arranged to lie in grooves formed in the drive rollers 23*a*, 23*b* when the cartridge 12 is in place on the printer 10. Each of the fingers 38 is arcuate in shape and wraps partially about and close proximity to the reduced diameter hubs 40 of the rollers 23*a*, 23*b* as suggested somewhat diagrammatically in FIG. 1. The fingers 38 may be secured to the sidewall 30 of the cover 26.

It should be understood that the details of the construction of the inlet region of the cartridge 12 do not form a part of the present invention and thus have been described only briefly, primarily to illustrate the environment in which the invention is employed. The present invention may be employed with other types of guiding and feeding mechanisms at the inlet end of a ribbon cartridge. For example, reference may be had to my prior application Ser. No. 897,861 for an explanation of another type of ribbon driving and guiding system at the inlet end of the cartridge.

From the foregoing it will be appreciated that as the rollers 23*a*, 23*b* continually draw and drive the ribbon R through the inlet end of the cartridge 12 and into the main body 14 of the cartridge 12, the ribbon R will be drawn out of the outlet end, through arm 18, in endless fashion.

In accordance with one embodiment of the present invention, the outlet region of the cartridge 12 is provided with an improved arrangement for inverting the ribbon R as it passes through the outlet region of the cartridge 12. As the ribbon R continually progresses through the storage chamber in the main body 14 of the cartridge 12, it then passes through a pair of guide pins 42 which are secured to the base 24 and cover 26 at the end of the storage chamber (see FIG. 7). The guide pins 42 preferably have polished outer surfaces and serve to locate the ribbon R in preparation to be passed through the ribbon inverting means as well as to serve as a ribbon dam to prevent the ribbon R in the storage compartment from interfering with movement of the ribbon R through the inverting means. The ribbon R then is guided to a corner guide pin 44 at the front corner of the outlet region of the cartridge 12. The ribbon R wraps about the corner guide pin 44 and then is directed toward and through the remainder of the ribbon inverting system.

Figure 7:
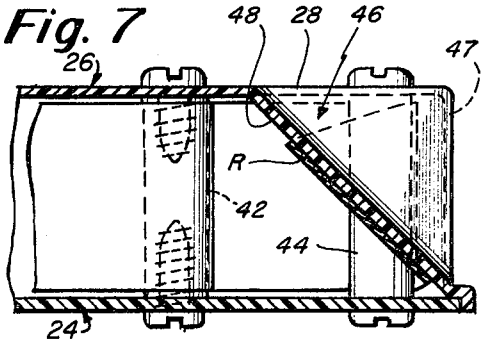
FIG. 7 is a sectional elevation of the outlet end of the cartridge as seen along the line 7—7 of FIG. 3.

In the embodiment illustrated in FIGS. 1–7 the ribbon inverting means is defined by a sequence of depressions or notches formed in the cover 26 and base 24 which define internal guiding ridges which are arranged to progressively guide and impart a twist to the ribbon R as it advances toward and through the outlet arm 18. In the illustrative embodiment, the ribbon inverting means includes a first notch 46 which is molded integrally with the cover 26. The first notch 46 is generally V-shaped and is formed at the juncture of the top wall 28 and endwall portion 47 of skirt 30 of the cover 26. The first notch 46 thus defines a first ridge 48 internally of the cartridge 12 as illustrated in FIG. 7. The first notch 46 may be formed so as to orient the ridge 48 to impart approximately a 45° twist to the ribbon R as it passes from the corner guide pin 44 to the first ridge 48.

Figure 6:
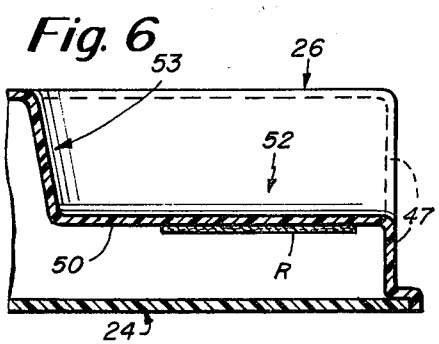
FIG. 6 is a sectional elevation of the outlet end of the cartridge as seen along the line 6—6 of FIG. 3.
Figure 5:
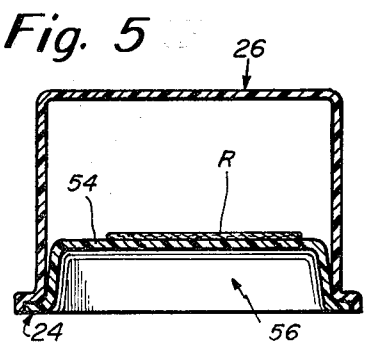
FIG. 5 is a sectional elevation of the outlet end of the cartridge as seen along the line 5—5 of FIG. 3.
Figure 4:
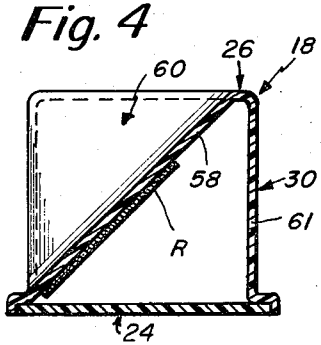
FIG. 4 is a sectional illustration of the outlet region of the cartridge as seen along the line 4—4 of FIG. 3.
Figure 2:
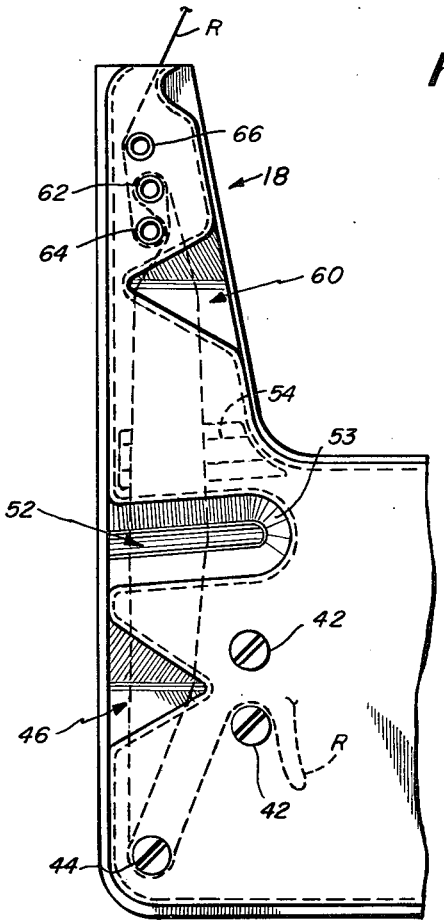
FIG. 2 is an enlarged plan view of the outlet end of the cartridge.

The ribbon passes along its path of travel from the first ridge 48 to a second ridge 50 which is defined by a second notch 52 also formed in the cover 26. The second notch 52 and second ridge 50 preferably are oriented to impart an additional 45° of twist to the ribbon R as it passes from the first ridge 48 to the second ridge 50, as illustrated in FIG. 6. It should be noted that the second notch 52 extends quite deeply into the body 14 of the storage compartment so that the inner end 53 (see FIG. 2) of the notch 52 serves as an additional dam to prevent any of the serpentine stored ribbon R from interfering with advancement of any part of the ribbon R through the inverting means.

A third ridge 54 is defined by a third notch 56 formed in the base 24. The third ridge 54 is located just slightly beyond and close to the second ridge 50 and also extends along a generally horizontal line, parallel to the second ridge 50. The third ridge 54 is intended to cooperate with the second ridge 50 to assure that the ribbon R does not become kinked or wrinkled.

The ribbon R passes from the third ridge 54 to a fourth ridge 58 which is defined by a fourth notch 60. The fourth notch 60 is formed along the outlet arm 18 and on the inside portion 61 of that part of the skirt 30 which defines the arm 18. The fourth notch 60 is formed so that the fourth ridge 58 extends along a line which will impart an additional 45° of twist to the ribbon R, the aggregate amount of twist from the corner guide pin 44 to the fourth ridge 58 being of the order of 135°.

The ribbon R then passes through a series of vertically oriented drag posts including a first post 62, second post 64 and third post 66. The drag posts 62, 64, 66 are secured at their top and bottom ends to the cover 26 and base 24 of the cartridge 12 in proximity to and between the fourth ridge 58 and outlet end of the outlet arm 18. The posts 62, 64, 66 serve to guide the ribbon R through its last increment of twist (fully inverted 180°) and also to impart a light drag on the ribbon R to assure that the exposed loop portion 20 of the ribbon R will remain sufficiently taut as the ribbon R is advanced endlessly. As illustrated, the ribbon R is guided from the fourth notch 60 to the first drag post 62, then rearwardly in a reverted manner (generally S-shaped), about the second drag post 64 and is again reverted and passed about the third drag post 66 from which it exits through the end of the outlet arm 18.

From the foregoing, it will be appreciated that by passing the ribbon R through the series of the first vertical corner guide pin 44, and then the series of ridges 48, 50, 54, 58 to the vertical drag posts 62, 64, 66, the ribbon R will be inverted 180°. It will be further appreciated that the ribbon inverting system of this invention is substantially simplified than with prior ribbon inverting devices in that no specially formed parts must be prefabricated and then assembled with the cartridge body. Rather, in accordance with the present invention, the notches 46, 52, 56, and 60, and tape-guiding ridges 48, 50, 54 and 58 are formed integrally with the base 24 and cover 26 at the time the base 24 and cover 26 are molded. In addition, it may be noted that there is a comparatively small area of contact between the ridges 48, 50, 54 and 58 and the ribbon R, as compared with a more traditional mobius loop type of inverting system, which results in reduced ribbon wear.

The invention has been illustrated as embodied in a cartridge 12 in which the halves of the cartridge 12 may be vacuum formed in accordance with conventional vacuum forming techniques. The cartridge 12 may be modified and may be formed in an injection molding procedure as illustrated in FIGS. 8–14.

Figure 8:
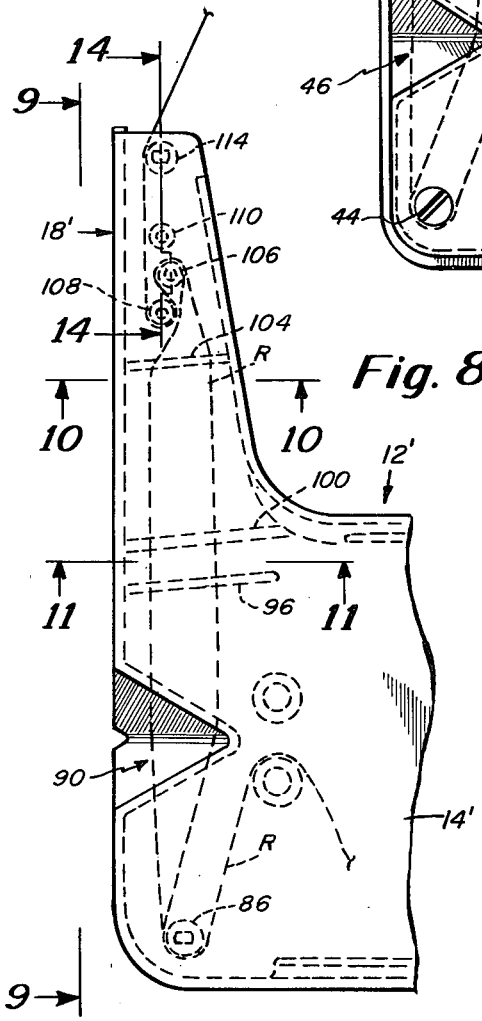
FIG. 8 is an enlarged plan view of the outlet end of a modified form of the cartridge.
Figure 9:
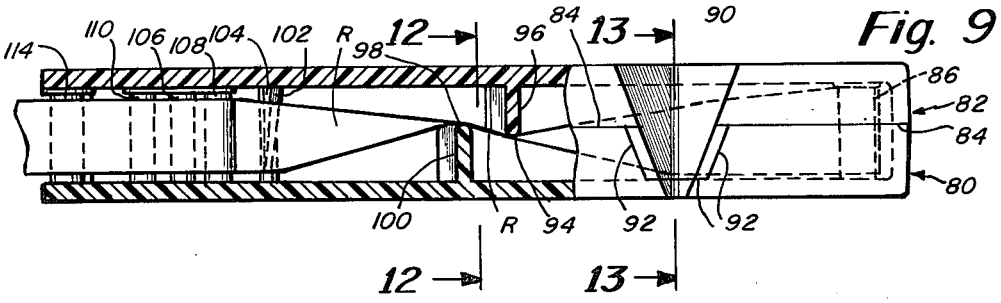
FIG. 9 is a partly broken-away and partly sectioned side elevation of the outlet end of the modified cartridge as seen along the line 9—9 of FIG. 8.
Figure 12:
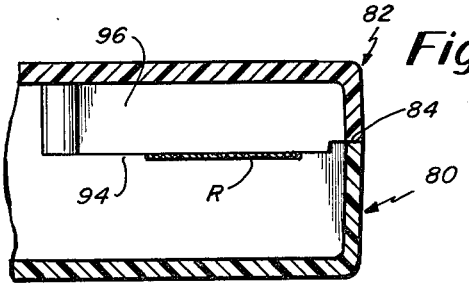
FIG. 12 is a sectional illustration of the outlet region of the modified cartridge as seen along the line 12—12 of FIG. 9.
Figure 13:
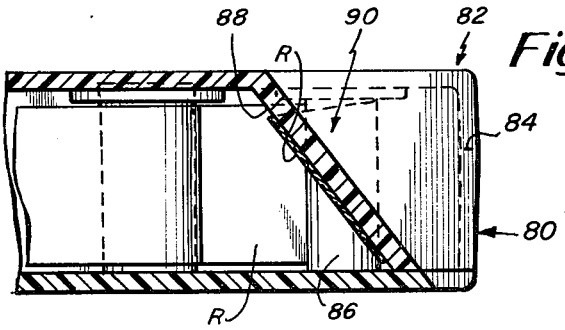
FIG. 13 is a sectional illustration of the outlet region of the modified cartridge as seen along the line 13—13 of FIG. 9.

As shown in FIG. 9, this embodiment of the invention may embody a pair of cartridge halves including a lower half 80 and upper half 82. The cartridge halves 80, 82 may be fabricated so that their parting line 84 is approximately midway along the height of the cartridge 12. As with the first described embodiment, the injection molded, modified form of the cartridge 12, also includes a ribbon inverting arrangement in which the ribbon R first is passed about a pin 86, then to a first ridge 88 which imparts approximately 45° of twist to the ribbon R, then to a second ridge 94 and a third ridge 98 which impart an additional 45° of twist, then to a fourth ridge 102 and finally to a series of drag posts 106, 108, and 110 which complete the 180° inversion of the ribbon R. As shown in FIGS. 8, 9 and 13 the outlet region of the cartridge 12' includes a front corner post 86 about which the ribbon R is wrapped. The first ridge 88 is defined by a V-shaped notch 90 which is molded directly into the upper half 82 of the cartridge body 14'. The portion of the upper half 82 of the cartridge 12' which defines the notch 90 includes a lower end which projects downwardly from the normally disposed mid-height location of the parting line 84. Thus, as shown in FIG. 9, the parting line 84, in the region of the notch 90, jogs downwardly as indicated at 92. The ridge 88 defined interiorally of the cartridge 12' is oriented so as to impart approximately 45° of twist to the ribbon R, as the ribbon R advances from the corner post 86 to the ridge 88.

The second ridge in the series is indicated at 94 and is defined by the lower edge of a downwardly extending wall 96 formed integrally with the upper half 82 of the cartridge 12'. The third ridge, indicated at 98 is defined by the upper edge of a wall 100 which is molded integrally with and extends upwardly from the bottom half 80 of the cartridge 12'. The third ridge 98 is oriented horizontally to impart an additional 45° of twist to the ribbon R and the third ridge 98 operates with the second ridge 94 to maintain the ribbon R flat and wrinkle free. The second ridge 94 may be disposed slightly below the level of the third ridge 98 to cause the ribbon R to wrap very slightly about each of the ridges 94, 98. As illustrated in FIG. 8, the walls 96, 100 extend well into the interior of the cartridge 12' to serve as somewhat of a dam to prevent the serpentine ribbon R from interfering with advancement of the ribbon R through the inverting device.

Figure 10:
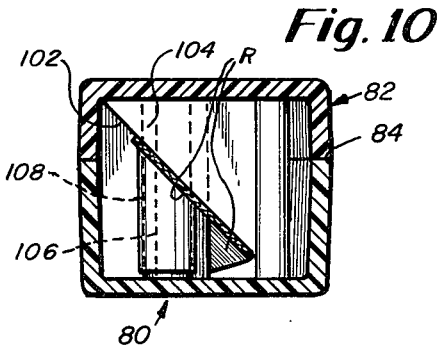
FIG. 10 is a sectional illustration of the outlet region of the modified cartridge as seen along the line 10—10 of FIG. 8.
Figure 11:
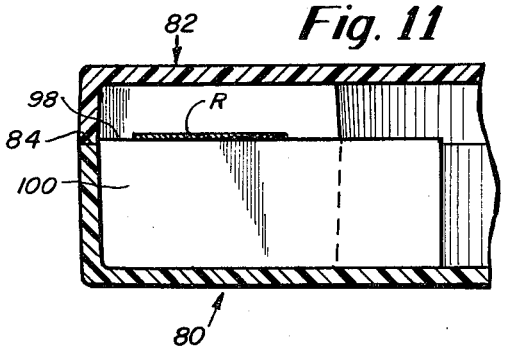
FIG. 11 is a sectional illustration of the outlet region of the modified cartridge as seen along the line 11—11 of FIG. 8.
Figure 14:
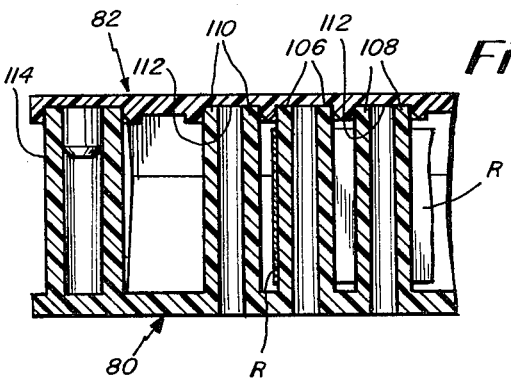
FIG. 14 is a sectional elevation of the outlet end of the modified cartridge as seen along the line 14—14 of FIG. 8.

After the ribbon R has been inverted 90° and leaves the third ridge 98, it then passes to a fourth ridge 102 which is defined by an edge of a wall 104 molded integrally with the upper half 82 of the cartridge 12' (see FIG. 10). The ridge 102 is oriented to impart an additional 45° of twist to the ribbon R. The ribbon R then passes through a series of three drag posts, 106, 108, 110 and are wrapped about the posts 106, 108, 110 in a reverted, S-shaped configuration in the same manner as in the previously described embodiment. In the present embodiment, however, it should be noted that the posts 106, 108, 110 are molded integrally with the bottom half 80 of the cartridge 12' as illustrated in FIG. 14. The upper ends of each of the posts 106, 108, 110 preferably is received in a shallow socket 112 formed in the upper half 82 of the cartridge 12'. A final, exit post 114 may be located at the outlet tip of the outlet arm 18'. Post 114 similarly is molded integrally with and extends upwardly from the lower half 80 of the cartridge 12' as shown in FIG. 14.

It should be understood that the foregoing description of the invention is intended merely to be illustrative thereof and that other modifications and embodiments of the invention may be apparent to those skilled in the art without departing from its spirit.

Having thus described the invention, what I desire to claim and secure by Letters Patent is:

1. A ribbon cartridge for a high speed printer comprising;

an elongated body and a pair of arms extending from opposite ends of the body and to one side thereof to form a generally U-shaped ribbon container, one of the arms being an outlet arm and the other an inlet arm;

an endless ribbon packaged in the container with an exposed loop extending between the ends of the arms, the body defining a storage chamber for storing a substantial portion of the endless ribbon in serpentine configuration, the storage chamber being in communication with the interior of the arms;

the cartridge having an opening for receiving a means for driving and advancing the ribbon endlessly through the cartridge; and ribbon inverting means disposed within the cartridge along the path of travel of the ribbon for inverting the ribbon before the ribbon exits from the outlet end of the outlet arm, said ribbon inverting means comprising a series of ridges located internally of the cartridge in spaced locations along the path of travel of the ribbon, said ridges being oriented so as to progressively guide the ribbon to an inverted configuration as the ribbon advances serially past the ridges;

said cartridge body being formed from a pair molded sections, including a base member and a cover member, said cover member including a top wall and a downwardly extending skirt which surrounds and defines the periphery of the cartridge, the lower edge of the skirt being secured to the base member;

said series of ridges which define said ribbon inverting means being formed directly in and being molded integrally with at least one of the base member and cover member;

said ridges being defined by generally V-shaped notches molded in at least one of the base member and cover member, the notches being formed exteriorly of the base member and cover member whereby the apex of the notches project interiorly of the cartridge and define said ridges.

2. A ribbon cartridge as defined in claim 1 further comprising:

means for maintaining a light drag on the ribbon as the ribbon is advanced through the ribbon inverting means.

3. A ribbon cartridge as defined in claim 2 wherein the means for maintaining a light drag comprises a pin located in proximity to but in advance of the ridges and means guiding the ribbon so that the ribbon wraps about a substantial portion of the pin before the ribbon engages the first of said ridges.

4. A ribbon cartridge as defined in claim 1 wherein said series of ridges comprises:

a first ridge oriented to twist the ribbon approximately 45° from the vertical;

a second ridge oriented to impart substantially an additional 45° of twist to the ribbon;

at least one additional ridge oriented to impart still another 45° of twist to the ribbon; and at least one drag pin disposed vertically within the cartridge and beyond the said at least one additional ridge, the drag pin being located with respect to the said at least one additional ridge and with respect to the path of travel of the ribbon to cause the ribbon to wrap about a portion of the drag pin thereby imparting a light drag on the ribbon before the ribbon exits from the outlet arm of the cartridge.

5. A ribbon cartridge as defined in claim 4 wherein said at least one additional ridge comprises a fourth ridge in said series thereof, the series of ridges further comprising:

a third ridge located between the second ridge and the fourth ridge and in proximity to the second ridge, the third ridge extending substantially parallel to the second ridge to assist in maintaining the ribbon in an unwrinkled configuration as the ribbon advances through the ribbon inverting means.

6. A ribbon cartridge as defined in claim 4 said at least one drag pin including:

a plurality of drag pins arranged in spaced configuration and in a manner which guides the ribbon in a generally S-shaped, reverted path before the ribbon exits fro the outlet arm of the cartridge.

7. A ribbon cartridge as defined in claim 1 further comprising:

said peripheral skirt of the cover member including a sidewall extending along the side of the cartridge and including and defining an outer sidewall of the outlet arm, said skirt further defining an inner sidewall of the outlet arm;

at least some of the V-shaped notches being formed in the juncture of the top wall and skirt of the cover member.

8. A ribbon cartridge as defined in claim 7 wherein at least one of the notches is formed in the base member.

9. A ribbon cartridge as defined in claim 8 wherein said series of ridges comprise first, second, third and fourth ridges formed by respective first, second, third and fourth V-shaped notches and wherein the first and second notches are formed in the juncture of the top wall and skirt of the cover member, the third notch is formed in the base member and the fourth notch is formed in the outlet arm along the juncture of the top wall and inner sidewall.

10. A ribbon cartridge as defined in claim 9 further comprising:

a pair of guide posts mounted in the cartridge at the terminal end of the ribbon container, the ribbon passing between the guide posts, the guide posts serving as a ribbon dam to prevent the ribbon from advancing into interfering engagement with the ribbon as the ribbon advances through the ribbon inverting means.

11. A ribbon cartridge as defined in claim 10 further comprising:

at least one of the notches being sufficiently deep and extending substantially toward the ribbon container to provide an additional dam means to prevent interference of the stored ribbon with that portion of the ribbon which advances through the ribbon inverting means.

12. A ribbon cartridge for high speed printer as defined in claim 1 further comprising:

said ribbon inverting means being located along the outlet region of the cartridge and having a portion thereof being disposed within the outlet arm.

13. A ribbon cartridge as defined in claim 1 wherein the cartridge body is formed in at least two parts by a vacuum forming technique.

14. A ribbon cartridge as defined in claim 1 wherein the cartridge body is formed in at least two parts by an injection molding technique.

15. A ribbon cartridge for a high speed printer comprising:

an elongated body and a pair of arms extending from opposite ends of the body and to one side thereof to form a generally U-shaped ribbon container, one of the arms being an outlet arm and the other an inlet arm;

an endless ribbon packaged in the container with an exposed loop extending between the ends of the arms, the body defining a storage chamber for storing a substantial portion of the endless ribbon in serpentine configuration, the storage chamber being in communication with the interior of the arms;

the cartridge having an opening for receiving a means for driving and advancing the ribbon endlessly through the cartridge; and ribbon inverting means disposed within the cartridge along the path of travel of the ribbon for inverting the ribbon before the ribbon exits from the outlet end of the outlet arm, said ribbon inverting means comprising a series of ridges located internally of the cartridge in spaced locations along the path of travel of the ribbon, said ridges being oriented so as to progressively guide the ribbon to an inverted configuration as the ribbon advances serially past the ridges;

said cartridge body being formed from a pair molded shelves including upper and lower halves and said ribbon inverting means comprising a series of serially arranged and spaced guides for imparting the inversion, said spaced guides including first, second, third and fourth ridges at least some of which impart a twist to the ribbon, wherein said first ridge is defined by a V-shaped notch and said second and third ridges are defined by opposite directed walls.

16. A ribbon cartridge as defined in claim 15 wherein said walls are arranged in parallel with one extending from one cartridge half and the other from the other cartridge half.

17. A ribbon cartridge as defined in claim 16 wherein the width of each wall is greater than the spacing between the walls.

18. A ribbon cartridge as defined in claim 15 wherein said upper and lower halves have a substantially midway part line.

19. A ribbon cartridge comprising;

an elongated body and a pair of arms extending from opposite ends of the body and to one side thereof to form a generally U-shaped ribbon container, one of the arms being an outlet arm and the other an inlet arm;

an endless ribbon packaged in the container with an exposed loop extending between the ends of the arms, the body defining a storage chamber for storing a substantial portion of the endless ribbon in serpentine configuration, the storage chamber being in communication with the interior of the arms;

the cartridge having an opening for receiving a means for driving and advancing the ribbon endlessly through the cartridge; and ribbon inverting means disposed within the cartridge along the path of travel of the ribbon for inverting the ribbon before the ribbon exits from the outlet end of the outlet arm, said ribbon inverting means comprising a series of ridges located internally of the cartridge in spaced locations along the path of travel of the ribbon, said ridges being oriented so as to progressively guide the ribbon to an inverted configuration as the ribbon advances serially past the ridges;

said series of ridges comprising at least one ridge defined by a notch formed exteriorly in the cartridge body with the apex of the notch disposed within the cartridge body so as to be in the path of travel of the ribbon and defining said at least one ridge.

20. A ribbon cartridge as defined in claim 19 wherein said notch is a V-shaped notch which is formed by a pair of converging walls.

21. A ribbon cartridge as defined in claim 20 wherein said cartridge body has a top wall, bottom wall and peripheral side wall with said converging walls each extending between the body top wall, body side wall, and said at least one ridge.

22. A ribbon cartridge as defined in claim 21 wherein each of the converging walls has a triangular shape and said converging walls are of substantially the same area.

23. A ribbon cartridge as defined in claim 21 wherein said series of ridges also include at least one ridge defined by opposite directed walls.

24. A ribbon cartridge as defined in claim 23 wherein said opposite directed walls are arranged in parallel with one opposite directed wall extending from the body top wall and the other opposite directed wall extending from the body bottom wall.

25. A ribbon cartridge as defined in claim 23 wherein the width of each opposite directed wall is greater than the spacing between the opposite directed walls.

* * * * *